US007522134B2

(12) United States Patent
Mizumaki

(10) Patent No.: US 7,522,134 B2
(45) Date of Patent: Apr. 21, 2009

(54) DISPLAY DEVICE AND DRIVING METHOD THEREOF

(75) Inventor: Hidetaka Mizumaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 678 days.

(21) Appl. No.: 11/130,924

(22) Filed: May 17, 2005

(65) Prior Publication Data

US 2005/0264549 A1 Dec. 1, 2005

(30) Foreign Application Priority Data

May 25, 2004 (JP) ..... 2004-154755

(51) Int. Cl.
*G09G 3/36* (2006.01)

(52) U.S. Cl. ..... 345/87; 345/204; 345/211

(58) Field of Classification Search ..... 345/87, 345/204, 211

See application file for complete search history.

(56) References Cited

U.S. PATENT DOCUMENTS

| | | | | |
|---|---|---|---|---|
| 5,764,139 | A | 6/1998 | Nojima et al. | |
| 6,078,302 | A | 6/2000 | Suzuki | |
| 6,937,224 | B1 | 8/2005 | Miyachi | |
| 7,012,598 | B2 * | 3/2006 | Park et al. | 345/204 |
| 2002/0003522 | A1 * | 1/2002 | Baba et al. | 345/89 |
| 2002/0047818 | A1 | 4/2002 | Yamamoto et al. | |
| 2003/0080932 | A1 | 5/2003 | Konno et al. | |
| 2003/0122772 | A1 | 7/2003 | Park et al. | |
| 2004/0141094 | A1 | 7/2004 | Kumamoto et al. | |
| 2004/0246242 | A1 | 12/2004 | Sasaki | |
| 2005/0237294 | A1 | 10/2005 | Miyachi | |

FOREIGN PATENT DOCUMENTS

EP 1 061 499 A2 12/2000

(Continued)

OTHER PUBLICATIONS

U.S. Appl. No. 11/109,932, "Display Device and Instrument Panel and Automobile Incorporating the Same," filed on Apr. 19, 2005.

(Continued)

*Primary Examiner*—Richard Hjerpe
*Assistant Examiner*—Leonid Shapiro
(74) *Attorney, Agent, or Firm*—Keating & Bennett, LLP

(57) ABSTRACT

The display device of the invention includes a display panel including a plurality of pixels arranged in a matrix of rows and columns, and switching elements each being connected to a corresponding one of the plurality of pixels; row driving circuits to for each selecting a row in the plurality of pixels by supplying a selection signal to the switching elements; column driving circuits for each supplying a data signal to pixels connected to the switching elements selected with the selection signal; and a black display signal generation circuit for generating a black display signal for causing the plurality of pixels to perform a black display. The data signal and the black display signal are supplied to each of the plurality of pixels during a period corresponding to one vertical scanning period. The display device further includes a black ratio control signal generation circuit for generating a black ratio control signal defining a ratio between a first period of retaining the data signal and a second period of retaining the black display signal.

20 Claims, 3 Drawing Sheets

FOREIGN PATENT DOCUMENTS

| | | | |
|---|---|---|---|
| JP | 06-102484 | | 4/1994 |
| JP | 09-175232 | * | 7/1997 |
| JP | 9-175232 A | | 7/1997 |
| JP | 10-020277 | | 1/1998 |
| JP | 2001-296838 | | 10/2001 |
| JP | 2002-108305 | | 4/2002 |
| JP | 2003-295156 A | | 10/2003 |
| JP | 2004-62134 A | | 2/2004 |
| WO | 03/032288 A1 | | 4/2003 |

OTHER PUBLICATIONS

Official communication issued in the counterpart European Application No. 05253119.1, mailed on Aug. 14, 2007.

* cited by examiner

DISPLAY DEVICE AND DRIVING METHOD THEREOF

BACKGROUND OF THE INVENTION

1. Field of the Invention

The present invention relates to a display device, and more particularly to a hold-type display device and a driving method thereof.

2. Description of the Related Art

In recent years, with the prevalence of liquid crystal display devices, there has been an increasing need for improved display quality.

One display quality problem which needs improvement is gray scale displaying performance. Specifically, liquid crystal display devices have problems in that their gray scale reproducibility is not sufficient. In order to solve this problem, a method for enlarging the dynamic range of an input image signal while also adjusting the luminance of a backlight is proposed in, for example, Japanese Laid-Open Patent Publication No. 2002-108305.

There is also a problem in that the display quality is likely to depend on the ambient brightness. In answer to this problem, a method which adjusts the luminance of a backlight in accordance with ambient brightness is proposed in, for example, Japanese Laid-Open Patent Publication No. 10-20277.

However, even by using the methods described in the aforementioned laid-open publications, it may still be difficult to obtain a sufficient display quality. The reason is that, since the luminance range of a cold-cathode tube which is generally employed in a backlight is limited to about 10% to 100%, there is a limit to the dynamic range of gray scale (luminance) levels which can be reproduced.

This problem is not just true to liquid crystal display devices, but is common to any hold-type display device that is equipped with a backlight. Furthermore, there is also a desire for improvement in the gray scale displaying performance of hold-type display devices of a self-emission type not requiring a backlight, e.g., organic EL display devices.

SUMMARY OF THE INVENTION

In order to overcome the problems described above, preferred embodiments of the present invention provide: a display device having an excellent gray scale displaying performance; and a driving method thereof.

A display device according to the present invention comprises: a display panel including a plurality of pixels arranged in a matrix of rows and columns, and switching elements each being connected to a corresponding one of the plurality of pixels; a row driving circuit for selecting a row in the plurality of pixels by supplying a selection signal to the switching elements; a column driving circuit for supplying a data signal to pixels connected to the switching elements selected with the selection signal; and a black display signal generation circuit for generating a black display signal for causing the plurality of pixels to perform a black display, wherein the data signal and the black display signal are supplied to each of the plurality of pixels during a period corresponding to one vertical scanning period, the display device further comprising a black ratio control signal generation circuit for generating a black ratio control signal defining a ratio between a first period of retaining the data signal and a second period of retaining the black display signal.

In one embodiment, the display device further comprises a photosensor for detecting an intensity of ambient light, wherein the black ratio control signal generation circuit generates the black ratio control signal in accordance with an output of the photosensor.

In one embodiment, the display device further comprises a clock, wherein the black ratio control signal generation circuit generates the black ratio control signal at a predetermined point in time. In this case, the predetermined point in time may be set by a user.

In one embodiment, the clock has a calendar function, and the black ratio control signal generation circuit generates the black ratio control signal at a predetermined month, date, and time.

In one embodiment, the predetermined month, date, and time are set by a user.

In one embodiment, the black ratio control signal generation circuit generates the black ratio control signal in response to a user operation.

In one embodiment, the black ratio control signal generation circuit generates the black ratio control signal based on a result of determining moving pictures from still pictures.

In one embodiment, the display device further comprises a moving picture/still picture determination circuit.

In one embodiment, the determination of moving pictures from still pictures is based on a content to be displayed.

In one embodiment, the display device further comprises a calculation circuit for calculating an average luminance of an input image signal (or input video signal), wherein the black ratio control signal generation circuit generates the black ratio control signal based on the average luminance.

In one embodiment, the value of the black ratio, represented as (second period/first period), is set to be equal to or greater than 0.315.

In one embodiment, the display device further comprises a backlight and a backlight regulation circuit, wherein the backlight regulation circuit adjusts a luminance of the backlight based on the black ratio control signal.

In one embodiment, the black ratio control signal generation circuit generates the black ratio control signal so as to define a black ratio which is greater than a predetermined reference value, and the backlight regulation circuit adjusts the luminance of the backlight to be less than a predetermined reference value. In this case, it is preferable that the display device gives a higher priority to a luminance adjustment through increasing the black ratio, than to the backlight luminance adjustment.

In one embodiment, the black ratio control signal generation circuit generates the black ratio control signal so as to define a black ratio which is less than a predetermined reference value, and the backlight regulation circuit adjusts the luminance of the backlight to be greater than a predetermined reference value.

In one embodiment, the display device further comprises a television receiver circuit.

In one embodiment, the display device is a display device for an instrument panel to be mounted in an automotive vehicle.

An automotive vehicle according to the present invention comprises any of the aforementioned display devices.

A driving method according to the present invention for a display device having a display panel including a plurality of pixels arranged in a matrix of rows and columns comprises the steps of, during a period corresponding to one vertical scanning period, supplying a data signal for each of the plurality of pixels and supplying a black display signal for each of the plurality of pixels, the method further comprising a step of determining a ratio between a first period of retaining the data signal in each of the plurality of pixels and a second period of retaining the black display. signal in each of the plurality of pixels.

In one embodiment, the display device further has a backlight; and the method further comprises a step of adjusting a luminance of the backlight based on the ratio between the first period and the second period.

The display device of the present invention provides improved gray scale display characteristics by utilizing a black insertion driving technique. The display device of the present invention is capable of setting an optimum black ratio (=black displaying period/image displaying period) in accordance with the ambient brightness and the type of image to be displayed, an thus provides improved gray scale display characteristics.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, an embodiment of the present invention will be described in detail with reference to the accompanying drawings.

By utilizing a black insertion driving technique, a display device according to the present invention adjusts the display luminance by adjusting the length of a black displaying period during one vertical scanning period, thus providing improved gray scale display characteristics. In the case of a display device incorporating a backlight, the present invention also performs an adjustment ("regulation") of backlight luminance to improve the gray scale characteristics. In other words, the present invention expands the luminance range (gray scale range) that can be expressed.

A "black insertion driving" technique is basically a driving method, used in a liquid crystal display device performing a hold-type display, where an impulse-type displaying similar to that performed in a CRT is performed. This technique may also be referred to as "pseudo impulse driving". By performing black insertion driving, the afterimage problems and blurring of moving pictures can be reduced, whereby the display quality for moving pictures can be improved.

Hereinafter, with reference to FIGS. 1A to 1C, black insertion driving will be described more specifically.

Figure 1A:
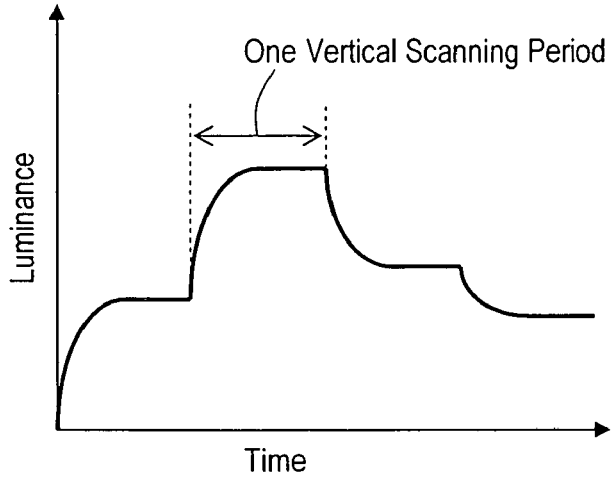
FIGS. 1A to 1C are graphs for explaining the principle of a black insertion technique utilized in a liquid crystal display device according to the present invention.
Figure 1B:
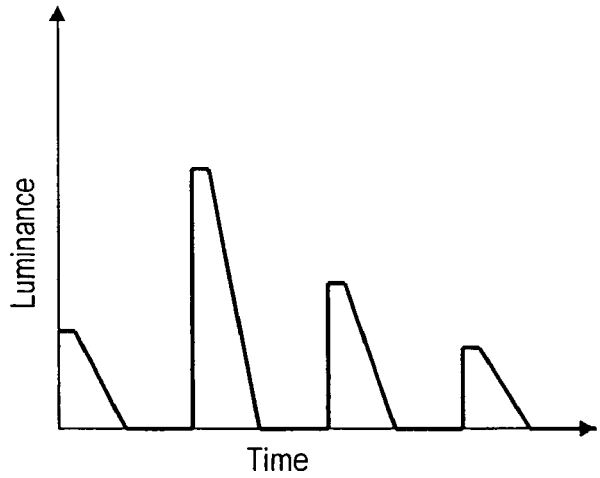

In liquid crystal display devices in general, as shown in FIG. 1A, hold-type display is performed. That is, the luminance corresponding to a data signal which is written in a given vertical scanning period is retained until a new data signal is written in a next vertical scanning period. On the other hand, in CRTs, impulse-type display is performed as shown in FIG. 1B. That is, light emission occurs only during a portion of one vertical scanning period. Note that one vertical scanning period corresponds to one frame in the case of non-interlace driving, and corresponds to one field in the case of interlace driving (where one frame is divided into a plurality of fields).

In the case where black insertion driving is performed, a "black display signal (which corresponds to displaying black)" is to be supplied to each pixel, during one vertical scanning period, at a point in time which is different from the point in time at which a data signal is supplied. Then, each pixel is controlled so as to retain the data signal for a predetermined portion (hereinafter referred to as a "first period") of the duration of time corresponding to one vertical scanning period, and retain the black display signal for the rest (hereinafter referred to as a "second period") of the vertical scanning period. As a result, as shown in FIG. 1C, pseudo impulse-type display can be performed, whereby the afterimage problems and blurring of moving pictures can be reduced. The first period and the second period are periods during which a data signal and a black display signal are retained, respectively, in each pixel (pixel capacitance). Note that, since the actual displaying state will be influenced by the response speed of the liquid crystal layer, the period of time during which black (for example) is displayed will actually be shorter than the second period.

Hereinafter, the ratio of the period during which a black display signal is retained (the "second period") to the period during which a data signal is retained (the "first period") will be referred to as a "black ratio". Since the black ratio=(second period/first period), if the vertical blanking time were to be ignored, it would follow that the black ratio=(second period/(one vertical scanning period−second period)]. For example, in order to achieve a black displaying state by using a liquid crystal layer whose fall (or decay) response time (i.e., a period of time required for luminance to transition from 100% to 10%) is 4 msec, it is necessary to satisfy the relationship: second period ≧4 msec. In the typical case where one vertical scanning period (=one frame) is 16.7 msec, it is necessary to satisfy the relationship: black ratio ≧0.315.

Figure 1C:
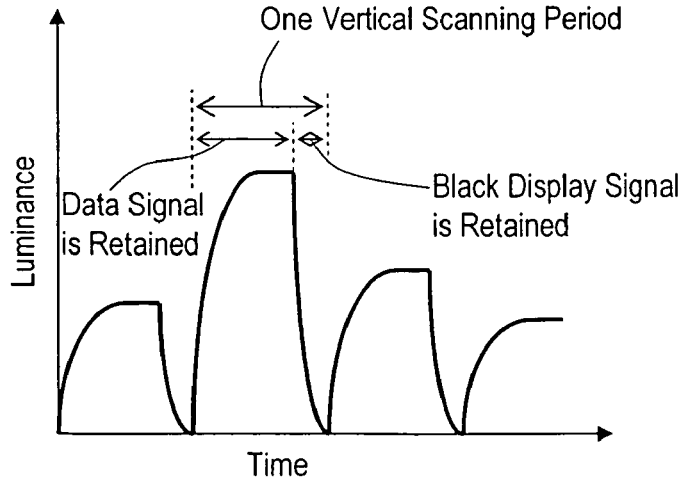

Although FIG. 1C illustrates an example where the luminance is lowered to a black displaying state within the period during which the black display signal is retained, it is not necessary that the luminance be lowered to a black displaying state within the period during which the black display signal is retained. If the amount of time for writing the black display signal (i.e., the amount of time for which the TFTs stay active during a write of the black display signal) is short, the response speed of the liquid crystal layer is slow. Alternatively, if the duration of time for which the black display signal is retained is short, the luminance may not be sufficiently lowered to attain a black displaying state in the strict sense (thus resulting in, e.g., only a 60% achievement rate). However, even in such cases, the effect of pseudo impulse driving can be obtained. Therefore, even in the case where a liquid crystal layer whose response time is 4 msec is employed, the second period may be less than 4 msec. It will be appreciated, however, that the length of the second period may be appropriately set in accordance with the response time of the liquid crystal.

Figure 2:
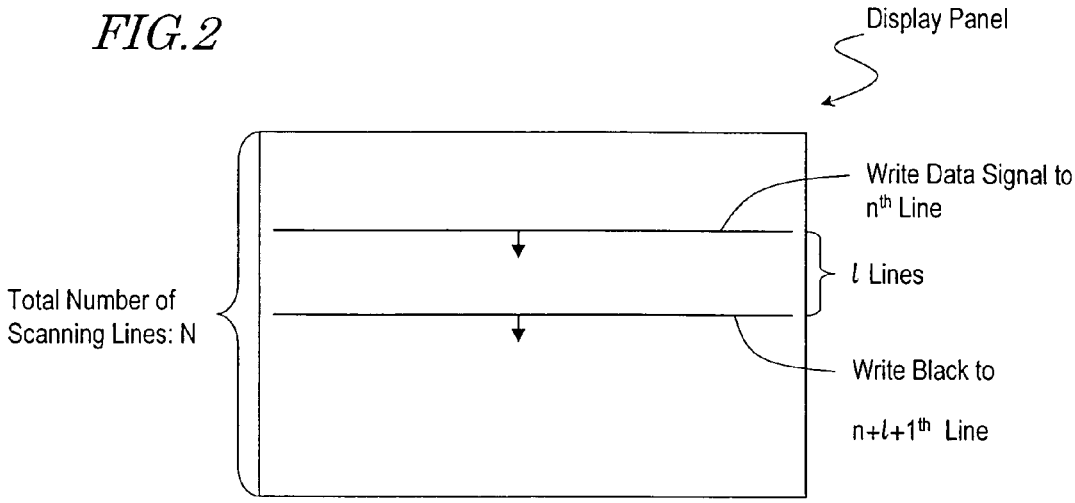
FIG. 2 is a schematic diagram illustrating a relationship between scanning for writing a data signal and scanning for writing a black display signal while black insertion driving is performed.

FIG. 2 schematically illustrates a relationship between scanning for writing a data signal and scanning for writing a black display signal while black insertion driving is performed. In a display panel shown in FIG. 2, the total number of scanning lines (the number of pixel rows) is N. The operation, which comprises writing a data signal to a pixel connected to an $n^{th}$ scanning line and then writing a black display signal to a pixel connected to an $n+1+1^{th}$ scanning line, is consecutively performed from the upper region to the lower region in FIG. 2. In one frame period, all of the N scanning lines are to be selected for a data signal write and a black display signal write. The period during which each pixel retains a black display signal is 1/N times of one frame period.

As a specific method of black insertion driving, any of a variety of known methods can be adopted. By using a method disclosed in Japanese Laid-Open Patent Publication No. 2001-60078 or Japanese Laid-Open Patent Publication No. 2001-296838, black insertion driving can be realized with a simple construction. The entire contents of Japanese Laid-Open Patent Publication No. 2001-60078 and Japanese Laid-Open Patent Publication No. 2001-296838 are hereby incorporated by reference.

As disclosed in Japanese Laid-Open Patent Publication No. 2001-60078, a structure may be adopted which can generate, as a black display signal for realizing black insertion driving, a signal which is different from a "black display signal" as defined by an exact level of data signal (i.e., a signal corresponding to the lowest gray scale level). In this case, it is possible to apply a voltage which is higher (or lower) than the voltage corresponding to the lowest gray scale signal to the liquid crystal layer. Therefore, the response speed of the liquid crystal layer when a black display signal is written can be improved, such that the luminance can be promptly brought to a black displaying state within the duration of time for which the black display signal is retained. Thus, the effect of reducing the afterimage problems and blurring of moving pictures can be sufficiently obtained.

Next, referring to FIG. 3, the structure and operation of a liquid crystal display device 100 according to an embodiment of the present invention will be described. As a black insertion driving technique, the liquid crystal display device 100 adopts the method described in Japanese Laid-Open Patent Publication No. 2001-60078.

The liquid crystal display device 100 includes a liquid crystal panel 11, a plurality of source drivers 12, and a plurality of gate drivers (row driving circuits) 13. The liquid crystal panel 11 includes a TFT substrate 14 and a counter substrate 15. On the TFT substrate 14, the following elements are formed: a matrix array of pixel electrodes 16; TFTs 17 whose drains are respectively connected to the pixel electrodes 16; gate bus lines G extending in parallel to one another, each of which is commonly connected to the gates of the TFTs 17 in each row; and source bus lines S extending in parallel to one another, each of which is commonly connected to the sources of the TFTs 17 in each column. On a counter substrate 15 which opposes the TFT substrate 14 with a predetermined interspace, a counter electrode 18 opposing the pixel electrodes 16 is formed. Between the pixel electrodes 16 and the counter electrode 18, a liquid crystal layer (not shown) is provided. The liquid crystal display device 100 further includes a display control section 20 for supplying various signals to the liquid crystal panel 11, a data signal reference voltage source 22, and a black display signal generation circuit 24.

As the liquid crystal panel 11, a VGA (video graphics array) panel is used, for example. There are 480 gate bus lines G and 640 source bus lines S (or three times that number in the case of a color display). The 480 gate bus lines G are divided into three groups each including 160 gate bus lines G, and these three groups are connected to the first gate driver 13*a*, second gate driver 13*b*, and third gate driver 13*c*. Similarly, the source bus lines S are divided into a plurality of groups, which are respectively connected to the source drivers (column driving circuits) 12.

The above-described structure of the liquid crystal display device 100 may be identical to the structure described in Japanese Laid-Open Patent Publication No. 2001-60078.

The liquid crystal display device 100 of the present embodiment includes a black ratio control signal generation circuit 30, such that an input image signal is supplied to the display control section 20 via the black ratio control signal generation circuit 30. To the black ratio control signal generation circuit 30, at least one of a photosensor 42, a clock 44, a selection switch 46, a calculation circuit 52 and a moving picture/still picture determination circuit 54 is connected.

A black ratio control signal which is output from the black ratio control signal generation circuit 30 is sent out to the display control section 20, a data signal reference voltage source 22 and the black display signal generation circuit 24, as well as to a backlight regulation circuit 62. The backlight regulation circuit 62 adjusts the luminance of a backlight 70.

Based on the black ratio control signal, the display control section 20 controls the gate drivers 13*a* to 13*c* so as to attain a predetermined black ratio. For example, the display control section 20 may include a scanning start signal generation circuit and an identification signal generation circuit (which are not shown in FIG. 3), and output the generated scanning start signal and identification signal to the gate drivers 13*a* to 13*c* together with a clock signal. As used herein, the "identification signal" is an identification signal for identifying whether a black display signal supplying. period (i.e., a period during which to supply a black display signal) currently exists or not. While in a black display signal supplying period, the gate drivers 13*a* to 13*c* supply a selection signal to at least one predetermined gate bus line G. While not in a black display signal supplying period, the gate drivers 13*a* to 13*c* supply a selection signal to one predetermined gate bus line G.

In order to write a data signal and a black display signal to each pixel so as to attain a predetermined black ratio during one vertical scanning period, selection signals are supplied to the gate bus lines in the follow manner.

For example, a selection signal is supplied to the $1^{st}$ gate bus line for writing a data signal thereto, and then a selection signal is supplied to the $161^{st}$ gate bus line for writing a black display signal thereto; thereafter, a selection signal is supplied to the $2^{nd}$ gate bus line for writing a data signal thereto, and then a selection signal is supplied to the $162^{nd}$ gate bus line for writing a black display signal thereto; and so on. This process is sequentially repeated. When a selection signal for writing a black display signal or a selection signal for writing a data signal has been supplied to the $480^{th}$ gate bus line, the process cycles back to the first gate bus line and repeats itself. In this manner, a black display signal will be retained in each pixel for one third (160/480) of one vertical scanning period, and a data signal will be retained in each pixel for two thirds of one vertical scanning period. Assuming that one vertical scanning period is 16.7 msec, it follows that a black displaying voltage is retained for about 5.6 msec, which is longer than the fall response time (e.g., 4 msec) of liquid crystal. Thus, it is possible to reach a sufficient level of black display.

It will be appreciated that the relative length of the black displaying period is not limited to one third of one vertical scanning period, but may be appropriately set in accordance with the response speed of the liquid crystal and/or the purposes for which the display device is used, as described above.

The sequence with which selection signals are supplied to the gate bus lines is not limited to the above example. Selection signals may be simultaneously supplied to a number of gate bus lines.

For example, in the case where a total of 1024 gate bus lines are provided, a selection signal may be supplied to the $1^{st}$ gate bus line for writing a data signal thereto, and then a selection signal may be simultaneously supplied to the four consecutive gate bus lines from the $257^{th}$ to the $260^{th}$ lines for writing a black display signal thereto; thereafter, a selection signal may be supplied to the $2^{nd}$ gate bus line for writing a data signal thereto, and then a selection signal may be simultaneously supplied to the four consecutive gate bus lines from the $258^{th}$ to the $261^{st}$ lines for writing a black display signal thereto.

Alternatively, a selection signal may be supplied to the $1^{st}$ gate bus line for writing a data signal thereto, and then a selection signal may be simultaneously supplied to two gate bus lines which are apart from each other by a predetermined number of lines, e.g., the $257^{th}$ and $513^{rd}$ lines, for writing a black display signal thereto; thereafter, a selection signal may be supplied to the $2^{nd}$ gate bus line for writing a data signal thereto, and then a selection signal may be simultaneously supplied to two gate bus lines which are apart from each other by a predetermined number of lines, e.g., the $258^{th}$ and $514^{th}$ lines, for writing a black display signal thereto.

Further alternatively, a selection signal may be supplied to the four consecutive gate bus lines from the $1^{st}$ to $4^{th}$ lines for writing a data signal thereto, and then a selection signal may be simultaneously supplied to the four consecutive gate bus lines from the $257^{th}$ to $260^{th}$ lines for writing a black display signal thereto; thereafter, a selection signal may be supplied to the four consecutive gate bus lines from the four consecutive gate bus lines from the $5^{th}$ to $8^{th}$ lines for writing a data signal thereto, and then a selection signal may be simultaneously supplied to the four consecutive gate bus lines from the $261^{st}$ to $264^{th}$ lines for writing a black display signal thereto.

By adopting any of the above-described sequences of simultaneously supplying a selection signal to a number of gate bus lines for writing a black display signal thereto, each period for writing a black display signal can be shortened, which is advantageous in that the period for writing a data signal can be prolonged.

In synchronization with the above-described gate driver operation, the source drivers supply a data signal and a black display signal to the source bus lines during each predetermined period.

The data signal reference voltage source 22 and the black display signal generation circuit 24 output to each source driver 12 a reference voltage for data signals and a voltage for black displaying, respectively, which are in accordance with the input black ratio control signal. The display control section 20 includes a clock signal generation circuit (not shown), and outputs to the source driver 12 a clock signal which is generated based on the black ratio control signal, together with the image signal.

The source driver 12 applies a DA conversion to the reference voltage for data signals, thus generating a data signal corresponding to the image signal, and based on the clock signal (switching clock signal) which is supplied from the display control section 20, supplies the data signal and the black display signal to the source bus lines with a predetermined timing.

The black ratio control signal generation circuit 30 of the liquid crystal display device 100 may generate a black ratio control signal in the following manner, for example.

The photosensor 42 detects the intensity of the ambient light, generates an intensity signal which is in accordance with the detected intensity, and outputs the intensity signal to the black ratio control signal generation circuit 30. Based on the intensity signal, the black ratio control signal generation circuit 30 determines a black ratio and accordingly generates a black ratio control signal.

For example, the value of the intensity signal is compared to a predetermined reference value, and if the value of the intensity signal is smaller than the reference value (i.e., if the ambient light is dark), a black ratio control signal is generated which represents a black ratio value that is greater than the reference value (so that a large portion of one vertical scanning period is accounted for by the second period of retaining a black display signal). As a result, during one vertical scanning period in each pixel of the liquid crystal panel 11, the second period of retaining a black display signal accounts for a length which is longer than the reference value, which means that the display luminance is lower than the reference level. It would become possible to further lower the display luminance by adopting an arrangement in which the backlight regulation circuit 62 lowers the luminance of the backlight 70 so as to be smaller than the predetermined reference value if the black ratio value is greater than the reference value.

By not only increasing the black ratio but also lowering the backlight luminance when the ambient light is dark, a level of darkness which cannot be attained by merely controlling the backlight luminance can be easily realized, e.g., a display luminance which is less than 10% of a display luminance (defined as 100%) of the case where the luminance of the backlight (cold-cathode tube) is set at the maximum value. Even by employing a conventional luminance controlling technique with a plurality of cold-cathode tubes (e.g., for a maximum luminance of 500 cd/m$^2$), it would be difficult to obtain a uniform decrease in luminance; for example, it would be difficult to attain a stable luminance level which is 3% or less of the maximum luminance. On the other hand, in accordance with the liquid crystal display device 100 of the present invention, the black ratio can be prescribed at an arbitrary value between 0 and 1, so that an arbitrary display luminance between 100% and 0% can be stably obtained.

For example, the display device of the present invention can be suitably employed in a display device for an instrument panel to be mounted in an automotive vehicle, or a display device for use within an automotive vehicle (e.g., a display device for car navigation). As used herein, an "automotive vehicle" may be any vehicle or machine which is capable of self propulsion and used for passenger or article transportation or moving of objects, e.g., a car, a motorbike, a bus, a truck, a tractor, an airplane, a motorboat, a vehicle for civil engineering use, a train, or the like. It will be appreciated that "automotive vehicles" are not limited to only those which are provided with internal combustion engines such as gasoline engines, but also encompass those provided with electric motors. In the following description, a car (automobile) will be taken as an example.

The brightness (ambient light intensity) within a car drastically changes in different situations. For example, the interior of a car would be very bright in the daytime in fine weather, but very dark at night and in tunnels. In such varying situations, a display device for an instrument panel or a display device for a car navigation apparatus must be able to present important information to a driver in a manner which is easy to see. In conventional display devices, it has been difficult to attain a sufficiently low display luminance in a very dark situation; therefore, in some display devices for car navigation apparatuses, negative images are displayed.

The liquid crystal display device 100 of the present embodiment is capable of not only controlling the black ratio, but also controlling backlight luminance, whereby a sufficiently low luminance, e.g., a luminance of 2 to 3 cd/m$^2$, can be obtained. Therefore, the liquid crystal display device 100 can display an image which is easy for the driver to see even in a very dark situation. Moreover, since a black insertion technique is adopted, the display quality for moving pictures is also high. Therefore, the liquid crystal display device 100 can be suitably employed for displaying images which contain fast movements on an instrument panel, e.g., a speedometer. It will be appreciated that backlight luminance adjustment is omittable; however, in order to obtain gray scale display characteristics over a broad dynamic range, it is preferable to perform backlight luminance adjustment.

In the presence of bright ambient light, the backlight luminance is set to a maximum luminance, and the black ratio is set to a minimum. Although the black ratio may be zeroed, in order to obtain a good moving picture quality, the black ratio should be appropriately set in accordance with the response characteristics of the liquid crystal and the desired moving picture quality so that the effects of black insertion can be obtained.

Although the above example illustrates a case where the black ratio and backlight luminance settings are changed relative to reference settings, it will be appreciated that the black ratio and/or backlight luminance may be changed in multiple levels, in accordance with the output from the photosensor 42.

Furthermore, in the case where the liquid crystal display device 100 is to be used as a display device for a car instrument panel, the black ratio may be changed in response to lighting operations by the user (who is typically the driver), instead of setting a black ratio in accordance with the photosensor output. Alternatively, the black ratio and backlight luminance may be changed in response to both the photosensor output and lighting operations by the user.

The liquid crystal display device 100 may also be suitably used as a television set, a monitor for a personal computer, and as a display device of an amusement device such as a video game machine, a pachinko apparatus, or a pachinko-slot machine.

In these display devices, too, images which are easier to see can be presented by adjusting display luminance in accordance with the brightness of ambient light. A photosensor may be provided near the display surface, and the black ratio and/or backlight luminance may be adjusted in accordance with the brightness of ambient light in the manner described above. It is preferable that photosensors are provided in a plurality of positions on the display surface in order to ensure accurate detection of the brightness around the display surface.

It is often the case that a display device such as a television set is employed in a fixed place, unlike an on-board display device. In such a mode of use, the brightness of ambient light varies with substantially constant time intervals. For example, the brightness around the display surface will change in accordance with the travel of the sun. In such a case, the clock 44 may be provided in the display device, and the black ratio control signal generation circuit 30 may be arranged so as to generate a black ratio control signal representing a predetermined black ratio which is in accordance with an output signal corresponding to the time which is output from the clock 44. For example, by utilizing time information as addresses, optimum luminance data may be stored in a memory within the black ratio control signal generation circuit 30, and a black ratio control signal may be output in accordance with the output data from the memory.

Furthermore, the clock 44 may have a calendar function, and the black ratio control signal generation circuit 30 may be arranged so as to generate a black ratio control signal representing a predetermined black ratio in accordance with the output signal from the clock 44 corresponding to the month, date, and time. As a result, it becomes possible to present a display with a desirable display luminance which supports changing seasons.

The relationship between the output signal from the clock 44 (which represents the time and the like) and the black ratio may differ depending on the place where the display device is employed. Therefore, it is preferable that the output from the clock 44 accounts for the place (i.e., location on the globe). Such settings may be stored in, for example, a memory in the clock 44. Furthermore, it is preferable that the user is able to change and/or add any such settings.

Of course, in addition to the aforementioned function of automatically adjusting display luminance in accordance with the brightness of ambient light and the time and the like, it is preferable that the user is able to change the display luminance on the fly. For example, the black ratio and/or backlight luminance may be made adjustable by the user operating the selection switch 46. It is further preferable that values of the black ratio, backlight luminance, or a combination thereof which can be selected by the user operating the selection switch are stored in a memory so that a selection can be made therefrom. Of course, the user may be further enabled to makes changes and/or additions to a plurality of values or. combinations of values which are stored in the memory. Furthermore, the user may be allowed to set changing luminance values together with predetermined time intervals.

Moreover, the optimum display luminance which is easy to see may differ depending on not only the ambient brightness, but also the particular image to be displayed. As described above, liquid crystal display devices have a problem associated with gray scale display characteristics, this problem being particularly outstanding with lower gray scale levels (i.e., lower display luminance). Since a liquid crystal display device is a typical example of a hold-type display device, its moving picture displaying performance may be inferior if a black insertion technique is not utilized. In particular, the recent diversifications in the modes of use have led to display devices for television sets or personal computers which are required to display both still pictures and moving pictures. Note that a television set may be constructed by further incorporating a television receiver circuit in the liquid crystal display device 100 shown in FIG. 3, where an output from the television receiver circuit serves as the input image signal in FIG. 3.

Now, an exemplary structure which detects the type of the image to be displayed and provides a display at an optimum display luminance in accordance with the detected type of image will be described.

Figure 3:
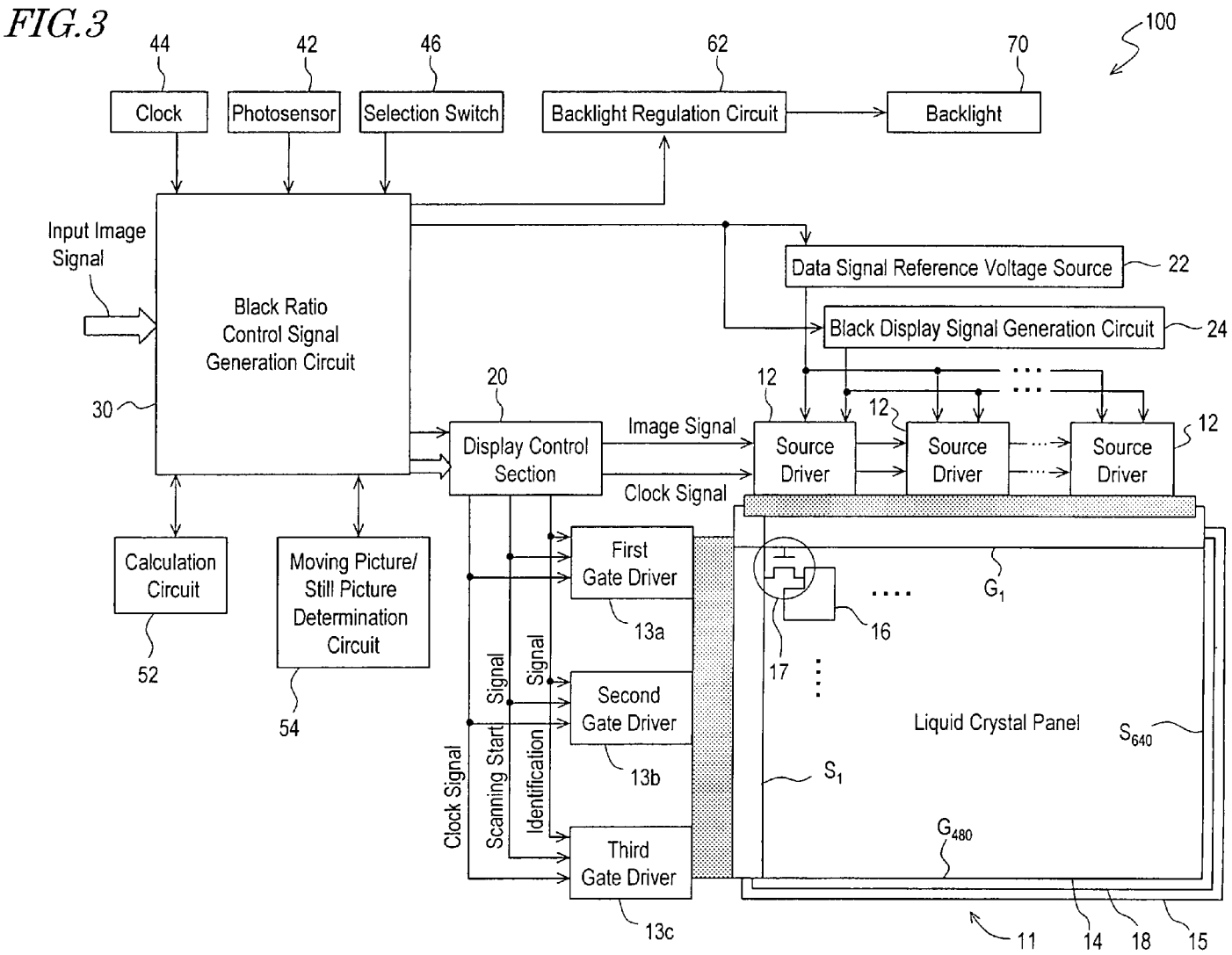
FIG. 3 is a diagram schematically showing the structure of a liquid crystal display device according to an embodiment of the present invention.

For example, as exemplified by the liquid crystal display device 100 in FIG. 3, a moving picture/still picture determination circuit 54 may be provided, and the input image signal may be supplied to the moving picture/still picture determination circuit 54 via the black ratio control signal generation circuit 30, such that the moving picture/still picture determination circuit 54 determines whether the input image signal represents moving pictures or still pictures, and that a black ratio is set in accordance with the determination result. For example, if the determination result indicates moving pictures, the black ratio and backlight luminance may be adjusted in such a manner that the black ratio is always equal to or greater than a predetermined value (e.g., 0.315 or more). As a method for determining moving pictures from still pictures, any of various known methods may be adopted. For example, the determination may be made through comparison between image signals over a plurality of frames. Alternatively, the determination may be made based on the format of the input signal (MPEG or JPEG), etc. Note that, in the case where the displayed content is known in advance, the moving picture/still picture determination circuit 54 may be omitted, and the timing for displaying still pictures and the timing for displaying moving pictures can be obtained from the outputter of the content (image source provider). For example, in the case where a media content such as a movie which is recorded on a DVD is to be displayed, the content may be determined to be moving pictures; and in the case where photographs or map information is to be displayed, the content may substantially be regarded as still pictures because of containing relatively small motions. Thus, based on the previously-obtained information of the content to be displayed, the determination as to moving pictures or still pictures may be made.

Furthermore, a calculation circuit 52 may be provided for calculating an average luminance of the input image signal, such that a black ratio is set in accordance with the brightness of the image to be displayed. In particular, in the case where the average luminance of the input image signal is low, the gray scale display characteristics at lower gray scale levels can be improved by lowering the overall display luminance. It will be appreciated that, in addition to or instead of average luminance, peak luminances may be detected, and the black ratio (and backlight luminance) may be adjusted based on the detected peak luminances.

Note that, in the case where more importance is attached to moving picture displaying performance in a display device which controls both the black ratio and the backlight luminance, it is preferable to give a higher priority to the luminance adjustment through increasing the black ratio, than to the backlight luminance adjustment.

As described above, in accordance with a display device and a driving method thereof according to the present embodiment of the invention, the display luminance range can be broadened relative to the conventional range. Moreover, since the luminance adjustment utilizes a black insertion driving technique, which provides for improved display characteristics for moving pictures, particularly outstanding effects will be exhibited for the two driving modes shown in Table 1 below.

TABLE 1

| Driving Mode | first mode | second mode |
|---|---|---|
| Backlight Luminance | low | high |
| Black Ratio | large | small |
| Features | MOVING PICTURE PERFORMANCE: Improvement is obtained as long as response to the data signal is not lost. Suitable for use with darker places/ luminance. | MOVING PICTURE PERFORMANCE: Deterioration is prevented as long as response to the black display signal is not lost. Luminance may be made as high as can be. |
| Applications | Bedrooms or other environments with little external light, e.g., night-time onboard use (dark places). | Environments which require a certain level of luminance, e.g., under the sunlight (bright places). |

Furthermore, the method described in Japanese Laid-Open Patent Publication No. 2002-108305 may be employed to broaden the dynamic range in accordance with the average luminance of the input image signal, and the resultant fluctuations in the average luminance level may be corrected for by the method of the present invention based on black ratio (and backlight luminance) adjustment.

While Japanese Laid-Open Patent Publication No. 2002-108305 only describes a correction method based on backlight luminance adjustment, the present invention adjusts the black ratio (and optionally backlight luminance). Thus, there is provided an advantage in that accurate luminance adjustments can be performed, or that a broad adjustment range can be obtained. In this combination, too, the black ratio (and backlight luminance) may also be adjusted based on peak luminances.

Note that the liquid crystal display device 100 of the above embodiment only needs to include at least one of a photosensor 42, a clock 44, a selection switch 46, a calculation circuit 52, and a moving picture/still picture determination circuit 54; it is not necessary for the liquid crystal display device 100 to include all of these elements. Furthermore, these elements do not even need to be internalized in the liquid crystal display device 100, but may be provided externally to the liquid crystal display device 100, as long as a predetermined signal can be supplied to the black ratio control signal generation circuit 30. For example, a calculation circuit and a memory for storing various settings may be externally provided so as to allow additions or changes to be made by means of software. A selector may be used instead of a memory.

Although the above embodiment illustrates a liquid crystal display device for example, the present invention is not limited thereto, but is broadly applicable to hold-type display devices in general. In particular, the present invention is suitably used for a non-self-emission type display device equipped with a backlight.

The present invention can improve the gray scale display characteristics of a hold-type display device. In particular, when the present invention is applied to a display device which is used in an environment with changing ambient brightness, it is possible to provide a display with an optimum display luminance which is in accordance with the ambient brightness.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This non-provisional application claims priority under 35 USC §119(a) on Patent Applications No. 2004-154755 filed in Japan on May 25, 2004, the entire contents of which are hereby incorporated by reference.

What is claimed is:

1. A display device comprising:

a display panel including a plurality of pixels arranged in a matrix of rows and columns, and switching elements each being connected to a corresponding one of the plurality of pixels;

a row driving circuit for selecting a row in the plurality of pixels by supplying a selection signal to the switching elements;

a column driving circuit for supplying a data signal to pixels connected to the switching elements selected with the selection signal; and a black display signal generation circuit for generating a black display signal for causing the plurality of pixels to perform a black display;

a backlight; and a backlight regulation circuit; wherein the data signal and the black display signal are supplied to each of the plurality of pixels during a period corresponding to one vertical scanning period;

the display device further includes a black ratio control signal generation circuit that is arranged to generate a black ratio control signal defining a ratio between a second period of retaining the black display signal and a first period of retaining the data signal; and the backlight regulation circuit adjusts an on luminance of the backlight based on the black ratio control signal.

2. The display device of claim 1, further comprising a photosensor for detecting an intensity of ambient light, wherein the black ratio control signal generation circuit generates the black ratio control signal in accordance with an output of the photosensor.

3. The display device of claim 1, further comprising a clock, wherein the black ratio control signal generation circuit generates the black ratio control signal depending on the output of the clock.

4. The display device of claim 3, wherein the dependence of the black ratio control signal on the output of the clock is based on settings that can be changed by a user.

5. The display device of claim 3, wherein the clock has a calendar function; and the black ratio control signal generation circuit generates the black ratio control signal depending on a signal from the clock corresponding to a month, date, and time.

6. The display device of claim 5, wherein the dependence of the black ratio control signal on month, date, and time is based on settings that can be changed by a user.

7. The display device of claim 1, wherein the black ratio control signal generation circuit generates the black ratio control signal in response to a user operation.

8. The display device of claim 1, wherein the black ratio control signal generation circuit generates the black ratio control signal based on a result of distinguishing moving pictures from still pictures.

9. The display device of claim 8, further comprising a moving picture/still picture determination circuit.

10. The display device of claim 8, wherein the determination of moving pictures from still pictures is based on a content to be displayed.

11. The display device of claim 1, further comprising a calculation circuit for calculating an average luminance of an input image signal, wherein the black ratio control signal generation circuit generates the black ratio control signal based on the average luminance.

12. The display device of claim 1, wherein the value of the black ratio, represented as (second period/first period), is set to be equal to or greater than 0.315.

13. The display device of claim 1, wherein the black ratio control signal generation circuit generates the black ratio control signal so as to define a black ratio which is greater than a predetermined reference value, and the backlight regulation circuit adjusts the luminance of the backlight to be less than a predetermined reference value.

14. A display device comprising:

a display panel including a plurality of pixels arranged in a matrix of rows and columns, and switching elements each being connected to a corresponding one of the plurality of pixels;

a row driving circuit for selecting a row in the plurality of pixels by supplying a selection signal to the switching elements;

a column driving circuit for supplying a data signal to pixels connected to the switching elements selected with the selection signal; and a black display signal generation circuit for generating a black display signal for causing the plurality of pixels to perform a black display; wherein the data signal and the black display signal are supplied to each of the plurality of pixels during a period corresponding to one vertical scanning period;

the display device further includes a black ratio control signal generation circuit that is arranged to generate a black ratio control signal defining a ratio between a second period of retaining the black display signal and a first period of retaining the data signal;

the black ratio control signal generation circuit generates the black ratio control signal so as to define a black ratio which is greater than a predetermined reference value, and the backlight regulation circuit adjusts the luminance of the backlight to be less than a predetermined reference value; and the display device gives a higher priority to a luminance adjustment through increasing the black ratio, than to the backlight luminance adjustment.

15. The display device of claim 1, wherein the black ratio control signal generation circuit generates the black ratio control signal so as to define a black ratio which is less than a predetermined reference value, and the backlight regulation circuit adjusts the luminance of the backlight to be greater than a predetermined reference value.

16. The display device of claim 1, further comprising a television receiver circuit.

17. The display device of claim 1, which is a display device for an instrument panel to be mounted in an automotive vehicle.

18. An automotive vehicle comprising the display device of claim 17.

19. The display device of claim 1, wherein the display device is arranged to have at least two modes;

in a first mode of the at least two modes, the backlight luminance is set to a first luminance value and the black ratio is set to a first ratio;

in a second mode of the at least two modes, the backlight luminance is set to a second luminance value, higher than the first luminance value, and the black ratio is set to a second ratio, smaller than the first ratio.

20. A driving method for a display device having a display panel including a plurality of pixels arranged in a matrix of rows and columns and a backlight, the method comprising the steps of:

during a period corresponding to one vertical scanning period, supplying a data signal for each of the plurality of pixels and supplying a black display signal for each of the plurality of pixels, determining a ratio between a second period of retaining the black display signal in each of the plurality of pixels and a first period of retaining the data signal in each of the plurality of pixels; and adjusting a luminance of the backlight based on the ratio between the second period and the first period.

* * * * *